United States Patent [19]

Parent et al.

[11] 4,255,012

[45] Mar. 10, 1981

[54] CORROSION RESISTANT ELECTRODE CONNECTOR ASSEMBLY

[75] Inventors: Richard G. Parent, Waltham; Irving D. Elyanow, Lexington, both of Mass.

[73] Assignee: Ionics, Incorporated, Watertown, Mass.

[21] Appl. No.: 51,665

[22] Filed: Jun. 25, 1979

[51] Int. Cl.[3] ..... H01R 11/02

[52] U.S. Cl. ..... 339/242; 339/278 C; 339/DIG. 1

[58] Field of Search ..... 339/222, 242, 278 C, 339/DIG. 1

[56] References Cited

U.S. PATENT DOCUMENTS

| | | | |
|---|---|---|---|
| 1,552,619 | 9/1925 | Klugh | 339/222 |
| 3,224,077 | 12/1965 | Phlips | 339/278 C |
| 3,573,721 | 4/1971 | Teagno et al. | 339/277 R |
| 3,601,784 | 8/1971 | La Martine | 339/278 C |
| 3,851,296 | 11/1974 | Muchmore et al. | 339/DIG. 1 |

*Primary Examiner*—Joseph H. McGlynn

*Attorney, Agent, or Firm*—Norman E. Saliba

[57] ABSTRACT

A corrosion resistant electrode connector assembly suitable for use in electrodialysis cells is disclosed, in which a jacket of titanium pipe is closely and mechanically fitted over an electrically conducting pipe comprised, for example, of copper. The assembly is flattened, closed at one end, and drilled to receive a plurality of connecting bolts. In use, an electrical conductor cable is attached to the assembly at the open end and the connector assembly securely bolted to an electrode.

6 Claims, 6 Drawing Figures

CORROSION RESISTANT ELECTRODE CONNECTOR ASSEMBLY

BACKGROUND OF THE INVENTION

1. Field of the Invention

The invention resides in the field of electrodialysis cells and more particularly relates to electrode connector structures suitable for use in those cells.

2. Description of the Prior Art

The electrical connector which has been previously employed consists of a 316 stainless steel bar which has been drilled to accomodate bolts for fastening the flat bar to the electrode sheet or plate. A copper lug is silver soldered to the end of the bar in order to make a connection to a D.C. current carrying cable.

The typical problems encountered in this connector device include corrosion of the stainless steel bar and copper lug, and also failure of the silver solder connection resulting in the solder lug becoming detached from the bar. The corrosion problem is especially severe because the passage of electrical current into the electrodialysis stack tends to induce electrochemical attack of the connector assembly. This attack is aggravated by the wet and saline conditions prevailing around the connector area which is typical of water desalinization operations.

SUMMARY OF THE INVENTION

The invention may be summarized as a corrosion resistant, electrode connector assembly and the method for making the same, comprised of a pair of closely fitted pipes, one inside the other, which are flattened and closed at one end. An electrical conductor cable is inserted into and joined at the opposite open end. Holes are drilled in the broad surface of the assembly for joining the connector to an electrode by means of bolts. The outer pipe is preferably titanium or columbium, both well known for their corrosion resistant properties, and the inner pipe a highly electrically conductive, malleably material, preferably copper or aluminum.

A connector assembly formed in accordance with the above description has a number of features and advantages.

The pipe materials for manufacture are readily available in any desired length, which allows the construction of a connector of any size or configuration, without the necessity for special tooling.

Difficulties and expense encountered with plating techiques (flaking, chipping, poor adherence) are avoided while providing an outer corrosion resistant covering of far greater thickness that would be possible with plating.

An electrical conductor cable may be easily attached to the assembly by crimping, brazing, or soldering.

The conductor terminal provided by the assembly and the connector assembly itself are a single unit, reducing fabrication complexity and eliminating terminal-connector interface failure which may occur in other designs of a similar nature.

The merit of the invention will become more clear from the following description and drawings.

DESCRIPTION OF THE PREFERRED EMBODIMENT

Figure 1:
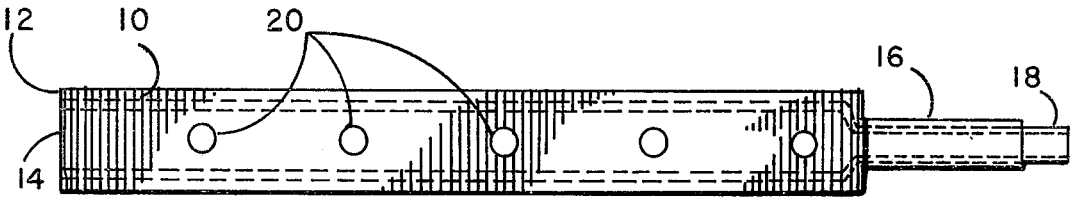
FIG. 1 is a top view of the preferred embodiment of the invention.
Figure 2:
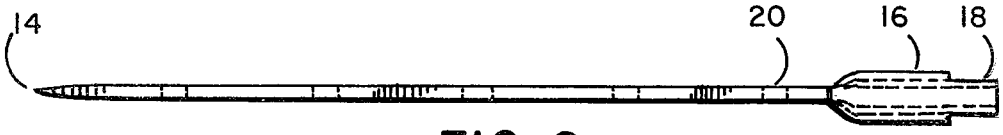
FIG. 2 is a side view of the apparatus of FIG. 1.
Figure 3:
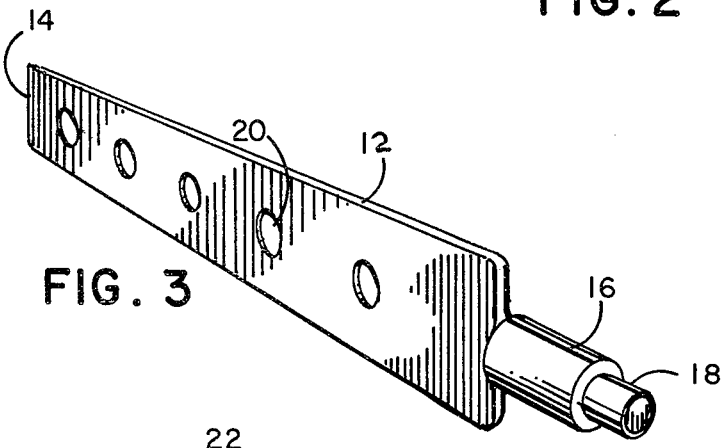
FIG. 3 is a perspective view of the apparatus of FIG. 1.

Referring to FIGS. 1, 2 and 3, there is illustrated the preferred embodiment of the invention comprised of a conductive core 10 and a jacket 12. The core is preferably copper pipe and the jacket titanium pipe. The assembly is formed by tightly inserting the core into the jacket, the inside diameter of the jacket being substantially the same as the outside diameter of the core. The pipes are then flattened and closed at end 14. A portion of the opposite end 16 of the assembly may be left open (unflattened) to receive a conductor cable. A portion 18 of the core may extend beyond the jacket to provide access for a firm mechanical-electrical contact. Holes 20 are drilled in the broad surface of the assembly to allow bolting the connector to a flat electrode surface or tab.

Figure 4:
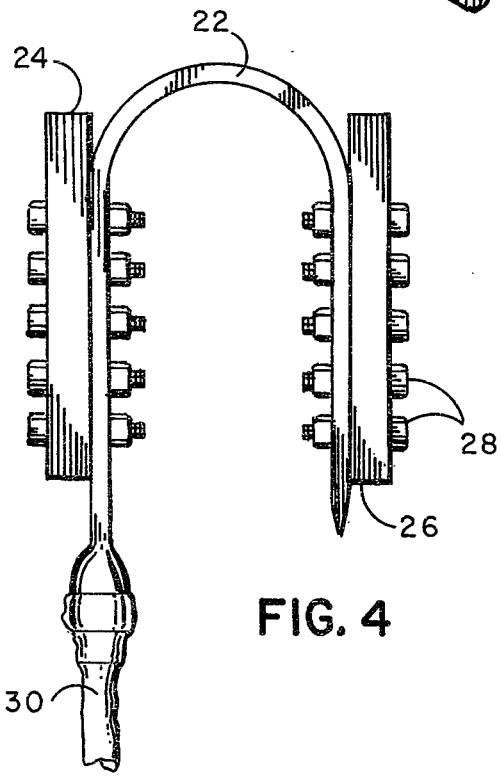
FIG. 4 is a side view of an additional embodiment of the invention in use.

The assembly may be formed into almost any shape and may, as shown in FIG. 4, be used to supply power to more than one electrode. The connector 22 is U-shaped and is connected to electrodes 24 and 26 by, for example, titanium bolts 28. Gaskets, not shown, may be employed where necessary between the bolts and the assembly to prevent any contact between the copper core partially exposed in the bolt holes and a corrosive environment. An electrical conductor cable is inserted in the open end of the connector and attached, for example, by brazing, soldering, or crimping. The entire end of the connector may be covered by a protective material 30.

Figure 5:
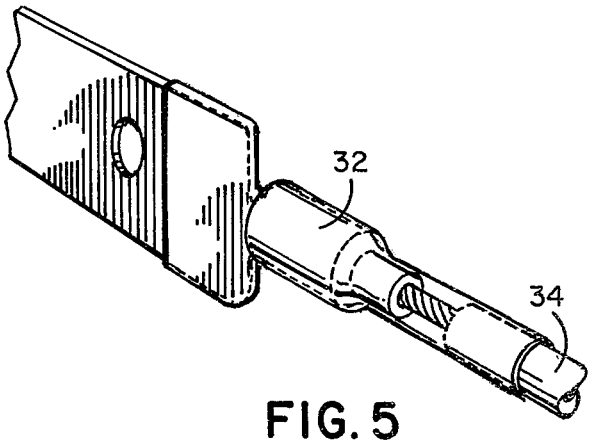
FIG. 5 is a perspective view of the apparatus of FIG. 1 illustrating an additional feature of the invention.
Figure 6:
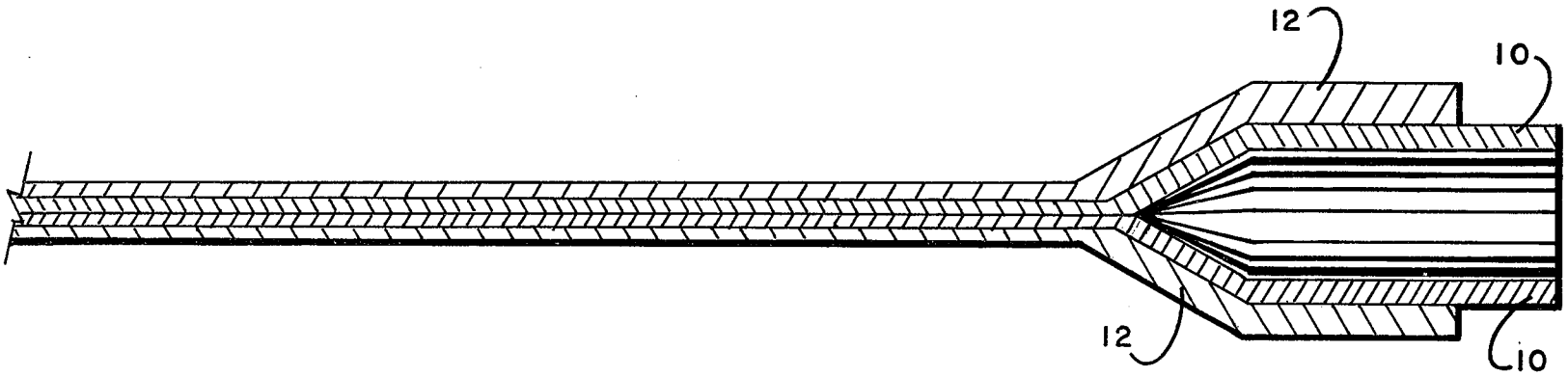
FIG. 6 is a side cross-sectioned view of the apparatus of FIG. 1.

FIG. 5 illustrates in detail the use of a heat shrinkable thermoplastic tubing 32 (such as polyethylene) to protect the exposed portion of the core and any part of the cable 34 not covered by insulation. A suitable material is available from AMP Special Industries, Valley Forge, Pennsylvania.

The electrode connector assembly described above has been found to effectively resist corrosive environmental conditions when employed in, for example, The Aquamite ® desalinization electrodialysis cell manufactured by Ionics, incorporated, Watertown, Massachusetts. The copper core provides a large surface contact area with the titanium jacket. This substantially reduces the resistance which would be encountered at the connector-cable juncture if a conductor cable was attached directly to a connector comprised wholly of titanium.

While round pipe is preferred, it will be obvious that other co-compatible shapes could be employed for the jacket and core. Accordingly, the word pipe as herein used is intended to encompass all cross-sectional tubing configurations where the external profile of the core fits closely within the internal profile of the jacket.

The embodiments of the invention in which an exclusive property or privilege is claimed are defined as follows:

1. A corrosion resistant electrode connector assembly for immersion in corrosive fluids comprising in combination:

a. an electrically conducting core of substantially flattened pipe;

b. a corrosion resistant protective jacket of substantially flattened pipe selected from the group consisting of titanium or columbium, tightly fitted over said core in close mechanical contact with said core over the entire inner surface of said jacket, said assembly closed at one end and open at the opposite end, said assembly having an unflattened portion of said core and said jacket at said open end, said core protruding from said jacket at said open end, said assembly having a plurality of holes transverse the broad surface of said assembly.

2. The apparatus of claim 1 wherein said core is selected from the group consisting of copper or aluminum.

3. The apparatus of claim 1 wherein said assembly is U-shaped.

4. The apparatus of claim 1 further including an electrical connector cable inserted into and attached to said assembly at said open end.

5. The apparatus of claim 4 further including a protective covering of heat shrinkable tubing over said assembly and said electrical connector at said open end.

6. The apparatus of claim 5 further including a plurality of titanium bolts and an electrode attached to said assembly by said bolts.

* * * * *